US010101011B2

(12) United States Patent
Markey et al.

(10) Patent No.: US 10,101,011 B2
(45) Date of Patent: Oct. 16, 2018

(54) LIGHT UNIT

(71) Applicants: Philip Andrew Markey, Carine (AU); Edward Joseph Khoury, Bateman (AU)

(72) Inventors: Philip Andrew Markey, Carine (AU); Edward Joseph Khoury, Bateman (AU)

( * ) Notice: Subject to any disclaimer, the term of this patent is extended or adjusted under 35 U.S.C. 154(b) by 445 days.

(21) Appl. No.: 14/984,699

(22) Filed: Dec. 30, 2015

(65) Prior Publication Data

US 2016/0195245 A1 Jul. 7, 2016

(30) Foreign Application Priority Data

Jan. 2, 2015 (AU) ..... 2015900005

(51) Int. Cl.

| | |
|---|---|
| ***F21V 14/02*** | (2006.01) |
| ***F21S 8/02*** | (2006.01) |
| ***F21V 14/04*** | (2006.01) |
| ***F21V 19/02*** | (2006.01) |
| *F21Y 105/10* | (2016.01) |
| *F21Y 115/10* | (2016.01) |
| *F21Y 107/10* | (2016.01) |
| *F21Y 107/30* | (2016.01) |

(52) U.S. Cl.

CPC ..... *F21V 14/02* (2013.01); *F21S 8/026* (2013.01); *F21V 14/04* (2013.01); *F21V 19/02* (2013.01); *F21Y 2105/10* (2016.08); *F21Y 2107/10* (2016.08); *F21Y 2107/30* (2016.08); *F21Y 2115/10* (2016.08)

(58) Field of Classification Search

None

See application file for complete search history.

(56) References Cited

U.S. PATENT DOCUMENTS

2017/0336060 A1* 11/2017 Stathes ..... F21V 21/28

* cited by examiner

*Primary Examiner* — Britt D Hanley

(74) *Attorney, Agent, or Firm* — Tope-McKay & Associates

(57) ABSTRACT

A light unit (10) comprising a housing (12) securable to a mounting surface such that a lower end thereof is adjacent the lower surface of the mounting surface. A light module (13) is mounted within the housing (12) having a first lighting emitting surface provided on a lower end surface (40) of the light module (13) and a second lighting emitting surface provided on a side surface (44). The light module (13) is mounted for movement relative to the housing (12) such that the light module (13) is movable between a retracted position in which the first lighting emitting surface is exposed and the second lighting emitting surface is covered by the housing (12), and an extended position in which the second lighting emitting surface is exposed.

20 Claims, 16 Drawing Sheets

LIGHT UNIT

FIELD OF THE INVENTION

The present invention relates to a light unit.

BACKGROUND TO THE INVENTION

The use of recessed lighting in houses is becoming increasingly common. Such downlights commonly use LED lighting and comprise a housing recessed into a ceiling having a lower exposed surface from which the light is emitted.

In some circumstances, such as entertaining, it is desired to use additional lighting to provide a special effect. The present invention relates to a light unit constructed to provide the features of both a standard recessed light along with additional lighting features which can be activated as desired.

SUMMARY OF THE INVENTION

According to one aspect of the present invention there is provided a light unit comprising:

a housing securable to a mounting surface such that a lower end thereof is adjacent the lower surface of the mounting surface;

a light module mounted within the housing;

a first lighting emitting surface provided on a lower surface of the light module; and a second lighting emitting surface provided on a side surface of the light module;

wherein the light module is mounted for movement relative to the housing such that the light module is movable between a retracted position in which the first lighting emitting surface is exposed and the second lighting emitting surface is covered by the housing, and an extended position in which the second lighting emitting surface is exposed.

Preferably, the light module is cylindrical in shape such that the first light emitting surface comprises a circular lower surface thereof and the second light emitting surface comprises a cylindrical side surface adjacent the lower surface.

Preferably, the first light emitting surface is provided with a first lighting device to emitting light downwardly therefrom and the second light emitting surface is provided with a second light emitting device to emit light radially outwardly therefrom.

Preferably the housing comprises a base portion and a fascia wherein the fascia is to be secured adjacent the mounting surface and the light module is mounted for movement relative to the base portion.

In one embodiment, the base portion comprises a body and a frame connected to the body wherein the body comprises a first cylindrical member being open at a first end and the frame comprises a second cylindrical member received within the first cylindrical member.

Preferably the second cylindrical member is movable relative to the first cylindrical member to cause the light module to move between the extended and retracted positions.

In one embodiment, the light module is engaged with the second cylindrical member such that rotation of the second cylindrical member causes translational movement of the light module between the extended and retracted positions.

Preferably, the light module includes a third cylindrical member secured around the outer surface thereof, the third cylindrical member including a plurality of helical grooves therein to receive lugs provided on the outer surface of the second cylindrical member such that rotation of the second cylindrical member causes translational movement of the third cylindrical member.

Preferably a motor is mounted to an inner surface of the first end of the body provided to rotate the second cylindrical member.

In one embodiment, the motor includes a drive shaft connected to a cog which engages with a plurality of teeth around the periphery of the first end of the second cylindrical member.

In one embodiment, the fascia comprises a ring being cylindrical in shape having a transverse flange on a first side thereof and pair of arm members extending from a second side thereof to engage with an outer surface of the body. Preferably distal ends of the arm members engage into recesses on opposed sides of the first cylindrical member.

In one embodiment, the second lighting device comprises a light ring having light emitting devices secured around the periphery thereof, the light ring being received about the cylindrical side surface.

Preferably a transparent cover ring is provided to secure around the cylindrical side surface and the light ring.

In one embodiment, a third light emitting surface is provided on an inner surface of the fascia and wherein the light module is moveable between first and second retracted positions such that the third light emitting surface is exposed by movement of the light module to the second retracted position.

Preferably the third light emitting surface comprises an inner surface of the ring of the fascia adjacent the transverse flange provided with inner lights and wherein the lower end surface of the light module is coplanar with the transverse flange in the first retracted position and retracted further within the fascia in the second retracted position.

In one embodiment, the light module includes a tilt mechanism provided to tilt the light module and therefore the lower end surface relative to the longitudinal axis of the housing to change the angle of the reflected light from the lower end surface.

In a further embodiment, a plurality of outer lights are provided around the periphery of the transverse flange of the fascia.

Preferably a diffuser ring is provided around the periphery of the transverse flange to diffuse the light from the outer lights.

BRIEF DESCRIPTION OF THE DRAWINGS

The invention will now be described, by way of example, with reference to the following drawings in which.

DETAILED DESCRIPTION OF PREFERRED EMBODIMENTS

Figure 1:
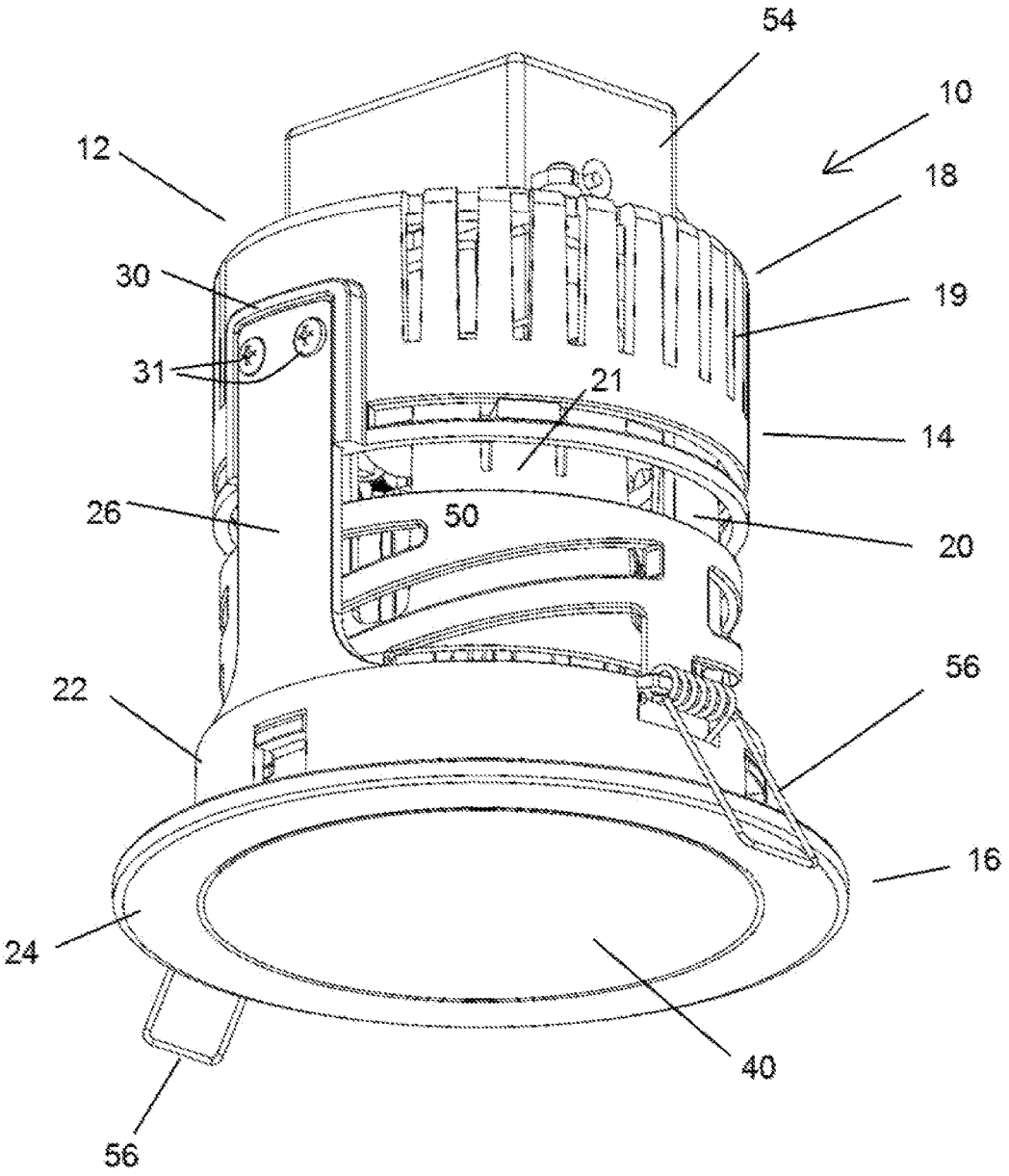
FIG. 1 is an lower perspective view of a light unit in accordance with the present invention.
Figure 2:
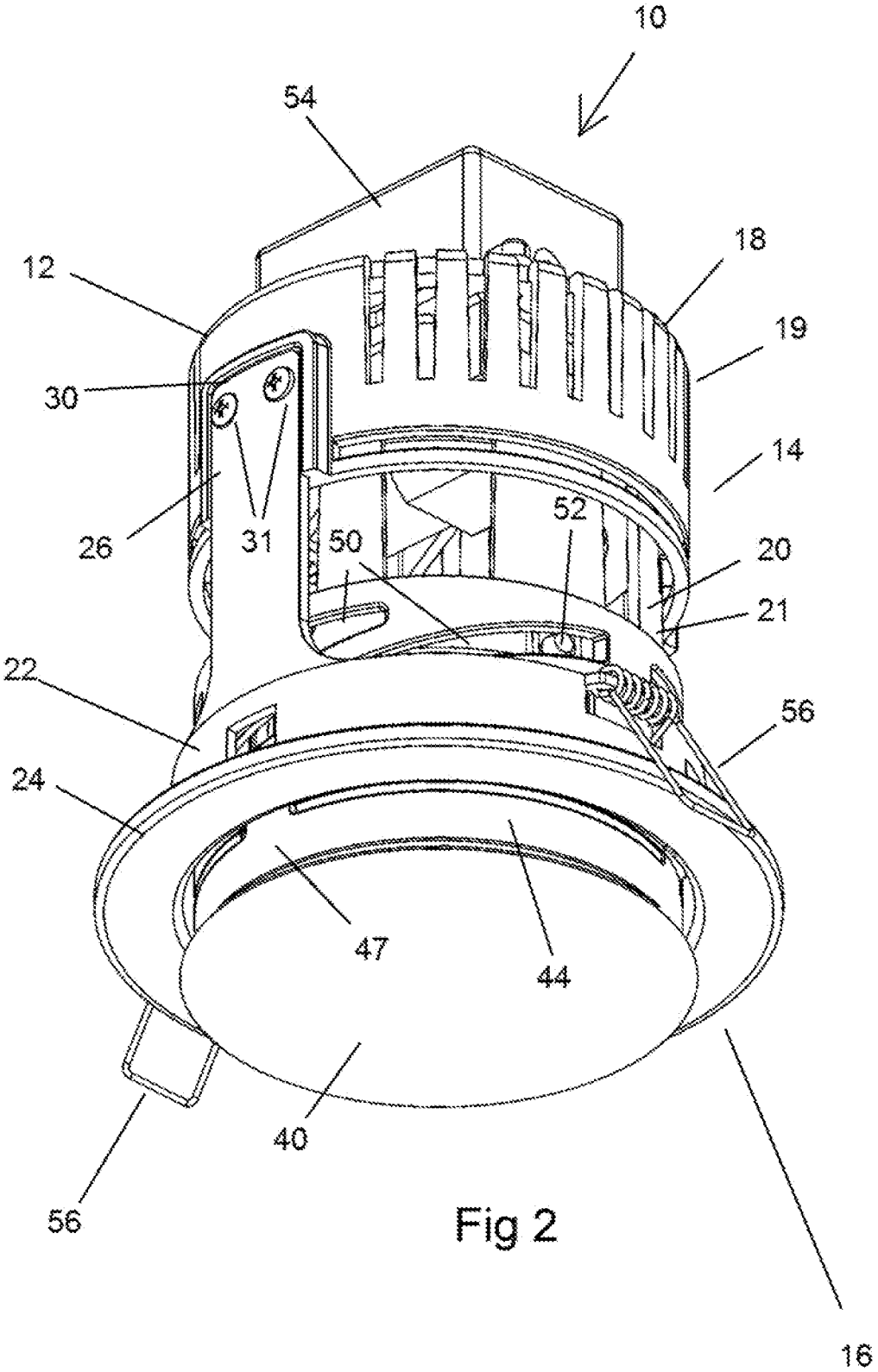
FIG. 2 is a lower perspective view of the light unit of FIG. 1 with the light module in an extended position.
Figure 3:
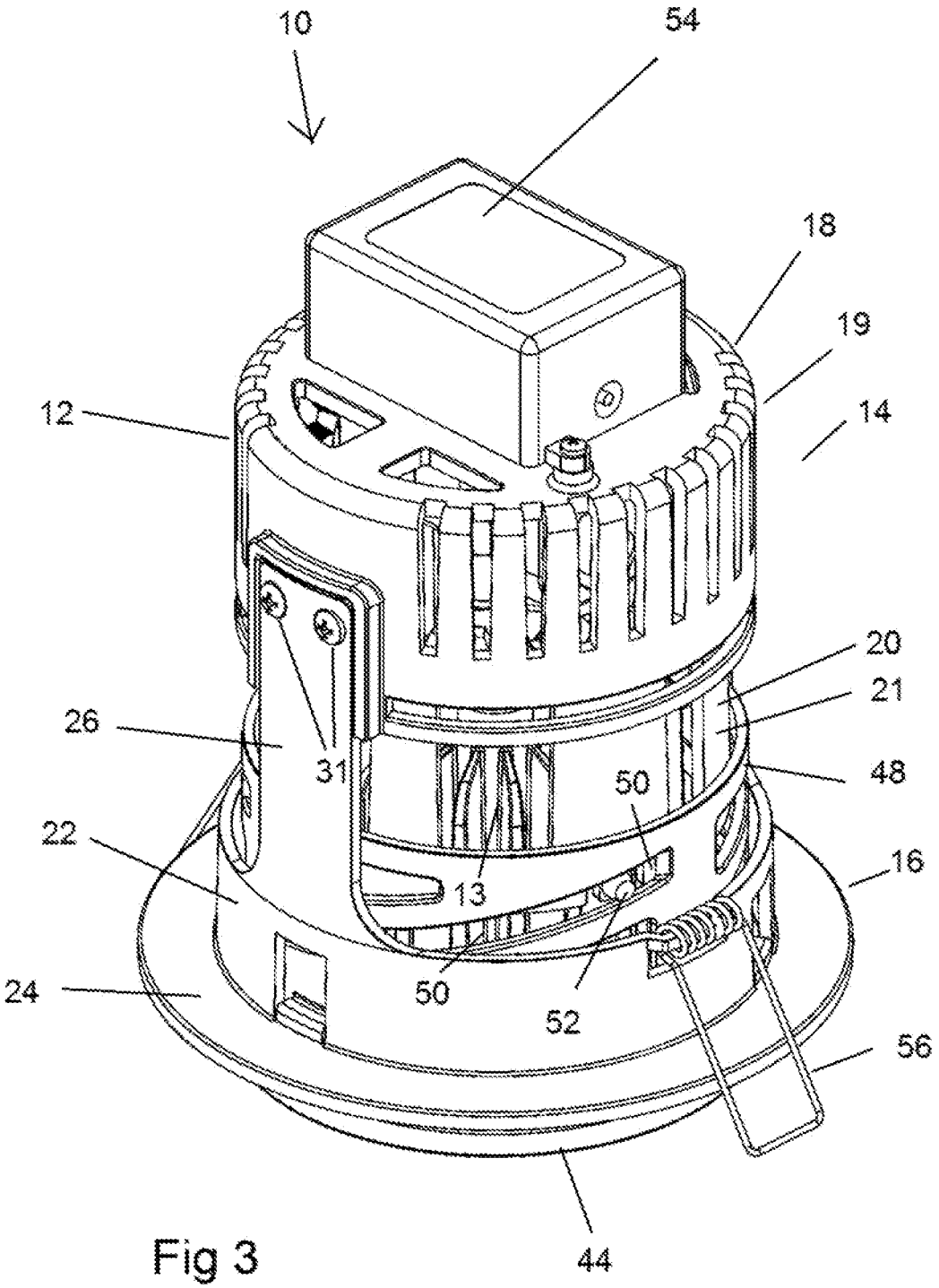
FIG. 3 is an upper perspective view of the light unit of FIG. 1 with the light module in the extended position.
Figure 4:
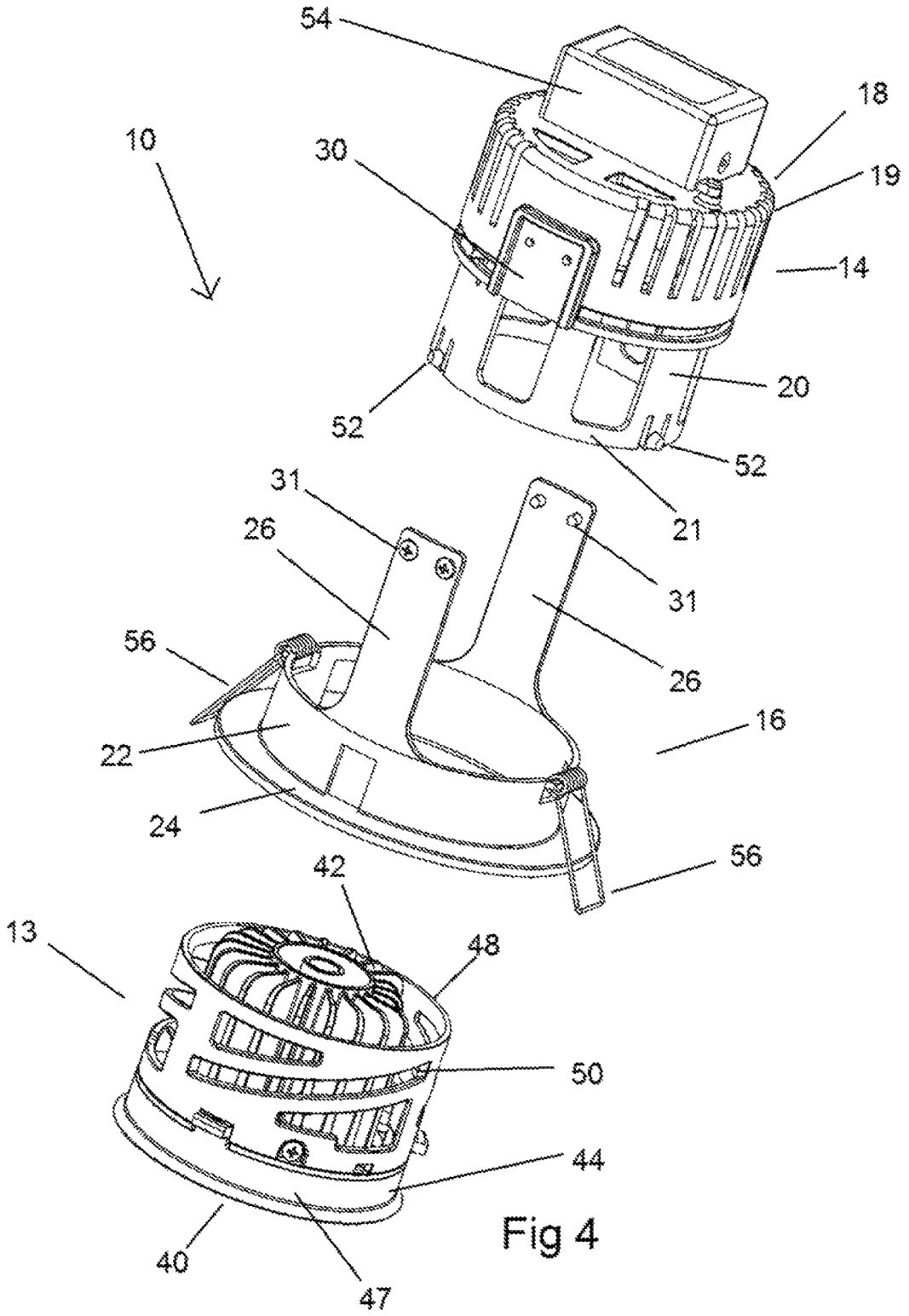
FIG. 4 is an exploded view of the light unit of FIG. 1.
Figure 5:
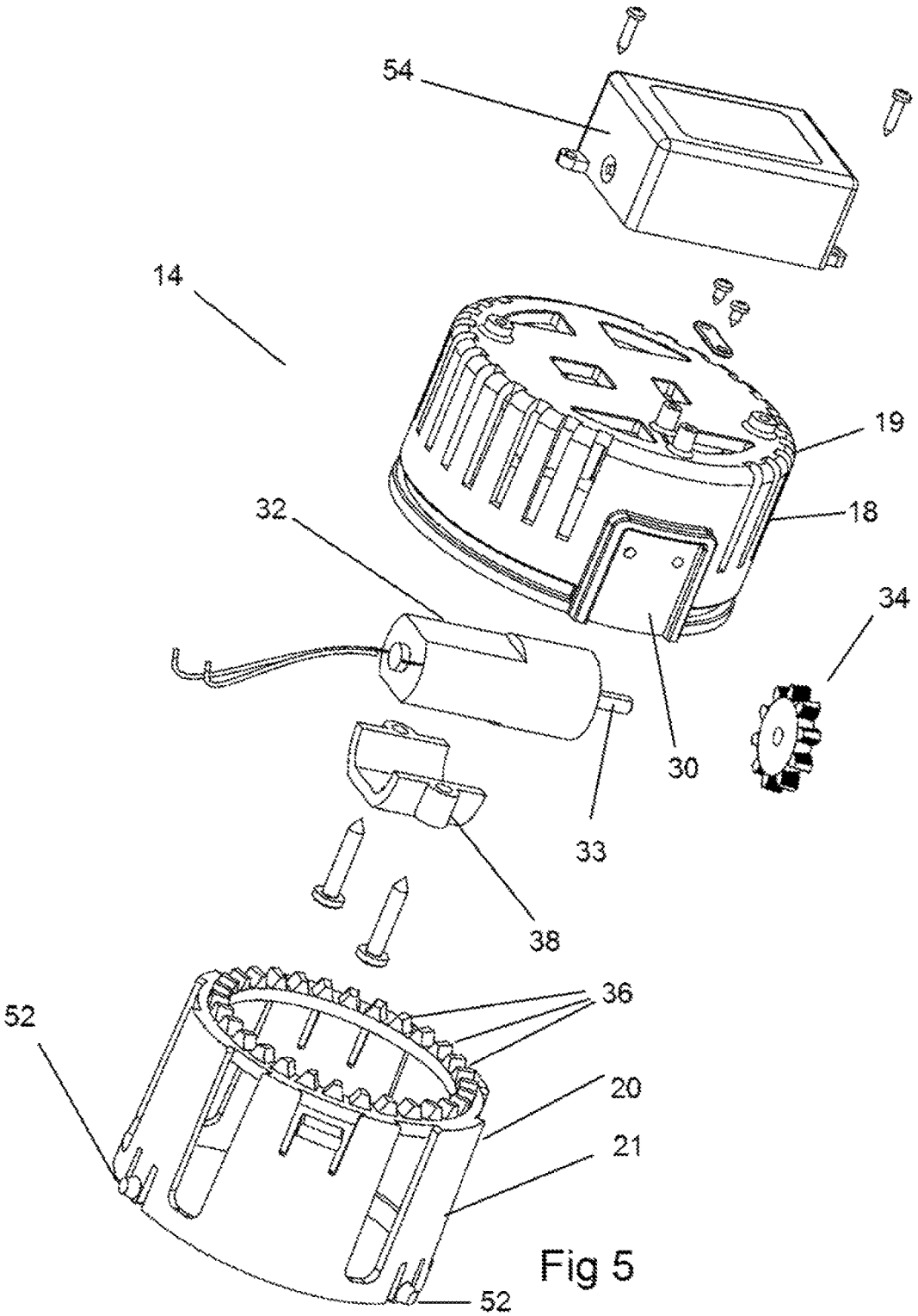
FIG. 5 is an exploded view of the base of the housing.
Figure 6:
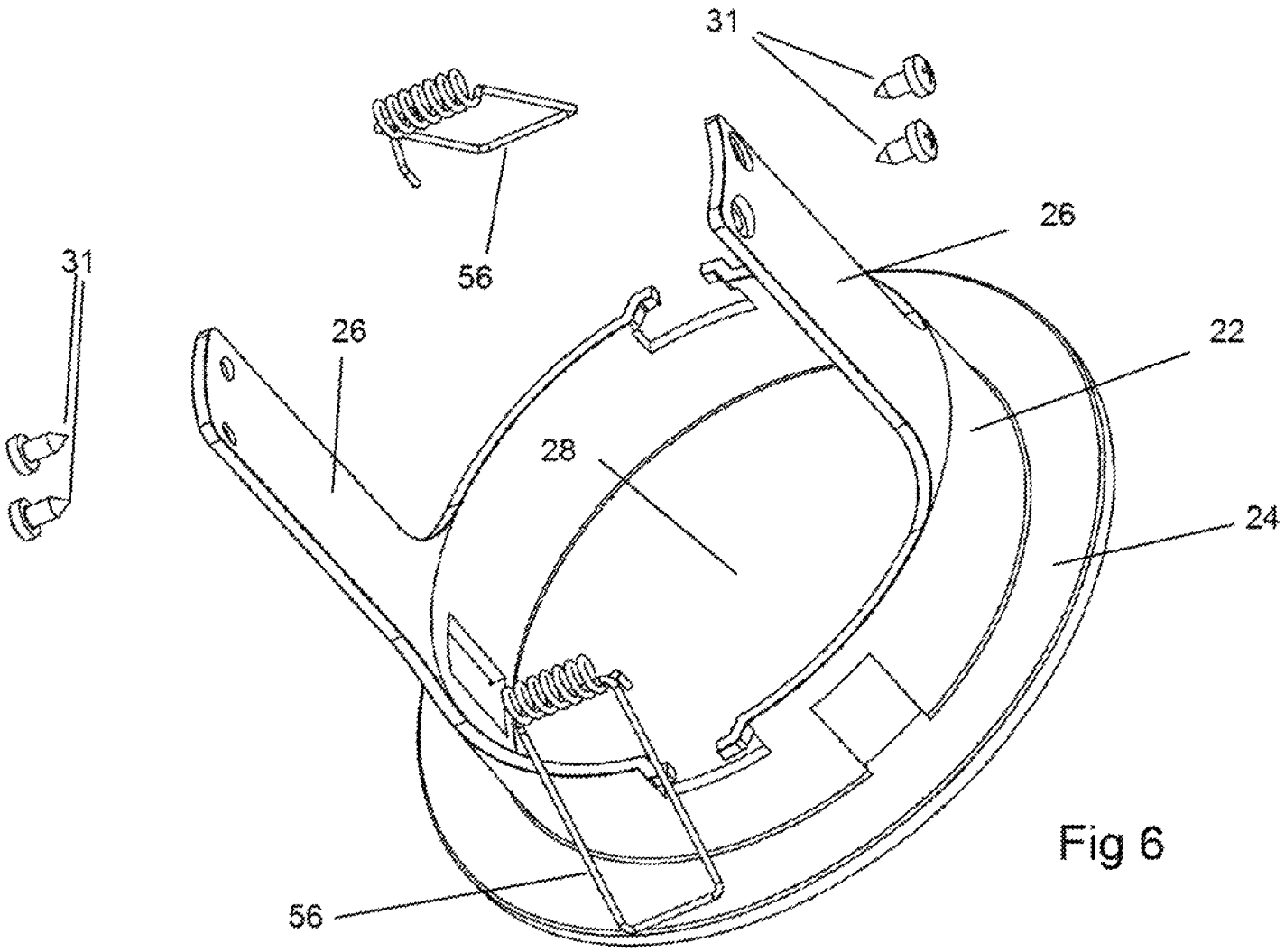
FIG. 6 is an exploded view of the fascia of the housing.
Figure 7:
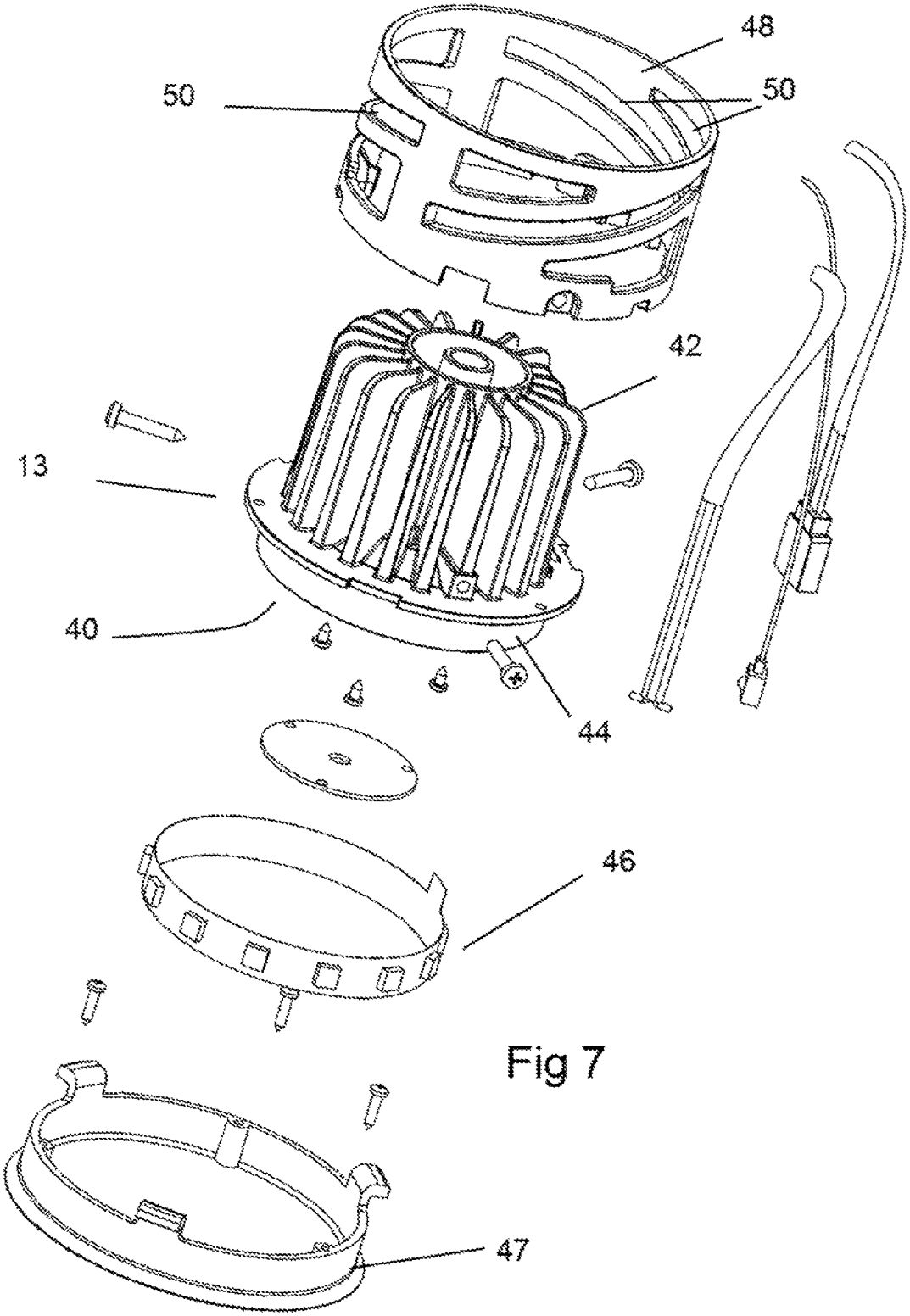
FIG. 7 is an exploded view of the light module of the light unit of FIG. 1.
Figure 8:
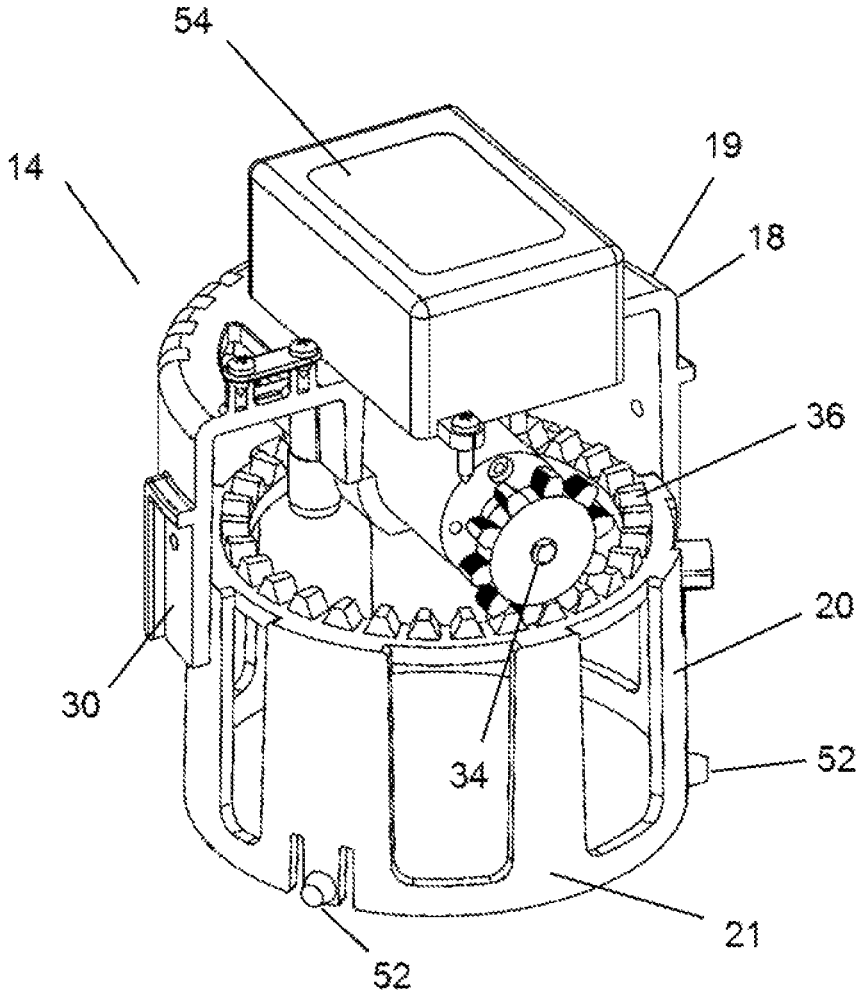
FIG. 8 is an upper perspective view of the body of the light unit of FIG. 1 with a portion cutaway.
Figure 9A:
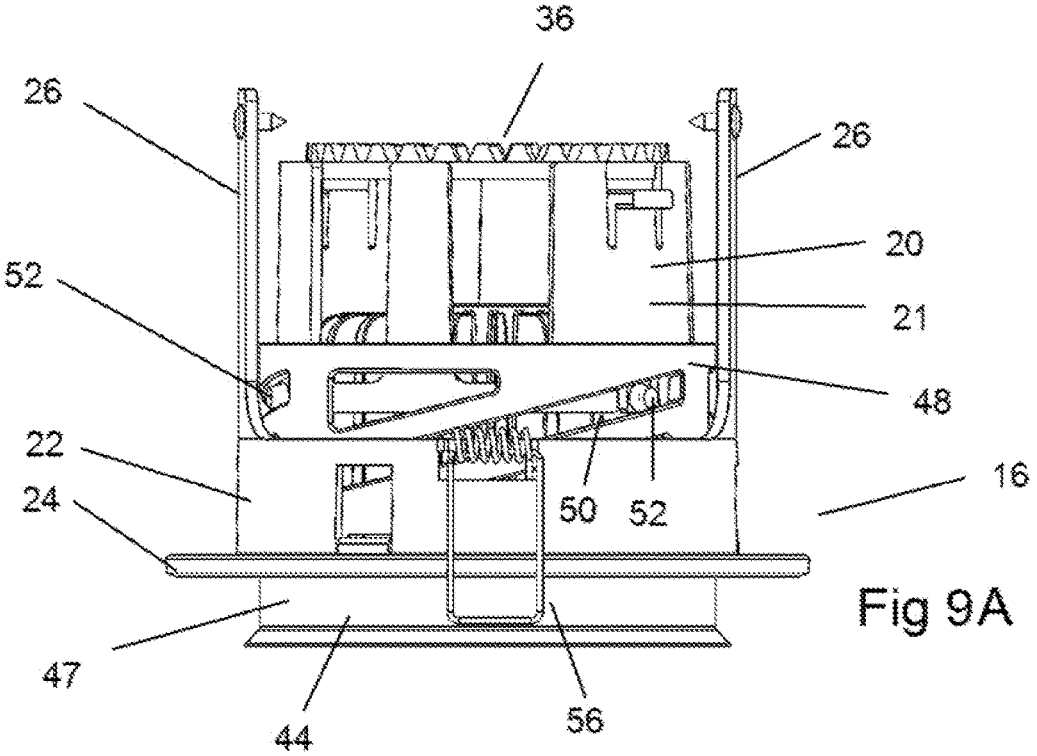
FIG. 9A is a side view of the light unit of FIG. 1 with the light module in the extended position.
Figure 9B:
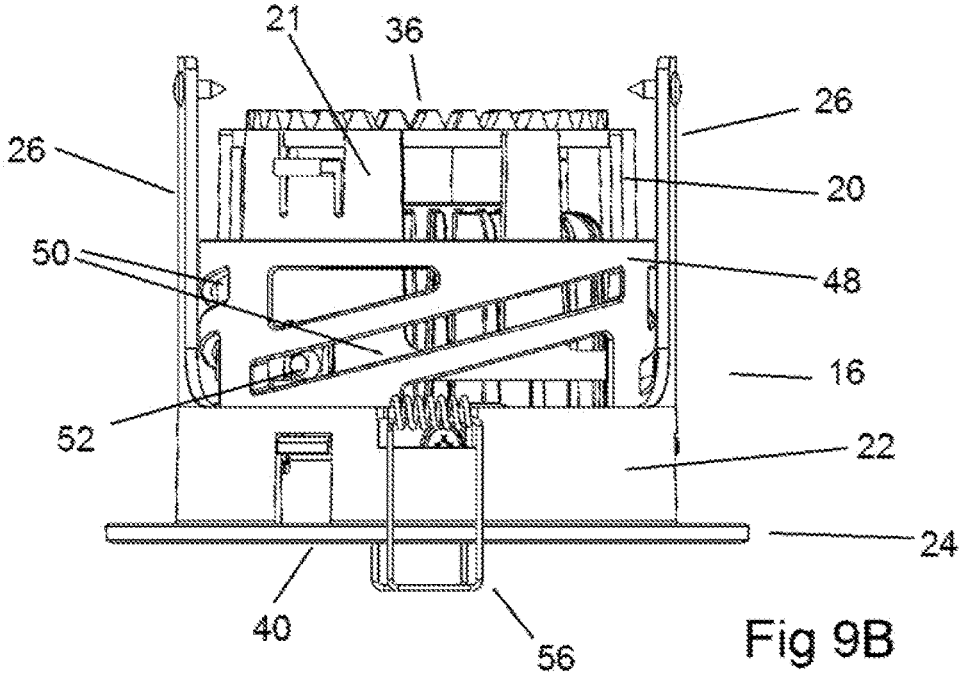
FIG. 9B is a side view of the light unit of FIG. 1 with the light module in the retracted position.

Referring to the Figures, there is shown a light unit 10 comprising a housing 12 and a light module 13. The housing 12 comprises a base portion 14 and a fascia 16. The light module 13 is provided to be received within the housing 12.

The base portion 14 comprises a body 18 and a frame 20 connected to the body 18. The body 18 comprises a first cylindrical member 19 being open at a first end and closed at a second end. The frame 20 comprises a second cylindrical member 21 being open at both ends. The second cylindrical member 21 of the frame 20 is of a smaller diameter than the first cylindrical member 19 such that the second cylindrical member 21 is receivable within the first cylindrical member 19.

The fascia 16 is connectable to the body 18. The fascia 16 comprises a ring 22 being cylindrical in shape having a transverse flange 24 on a first end thereof, being the end positioned lowermost. The ring 22 defines a circular opening 28. A pair of arm members 26 are provided extending from a second end of the ring 22. The arm members 26 each comprise elongate planar members extending parallel to each other from opposed sides of the ring 22. Proximal ends of the arm members 26 extend from the second end of the ring 22 and distal ends of the arm members 26 are connectable to the body 18. An outer surface of the body 18 is provided with recesses 30 on opposed sides thereof into which are received the distal ends of the arm members 26. The arm members 26 are securable in the recesses 30 by means of securing screws 31.

The light module 13 is generally cylindrical in shape. The light module 13 includes a first light emitting surface being a lower end surface 40 thereof. Light is emitted from the first light emitting surface by a first lighting device. The first lighting device preferably comprises an LED light. When the light unit 10 is mounted within a ceiling, the first lighting device therefore emits light downwardly from the lower surface 40 in the manner of a standard downlight. The light module 13 also includes a plurality of fins 42 around the outer surface thereof for heat dissipation.

Figure 10A:
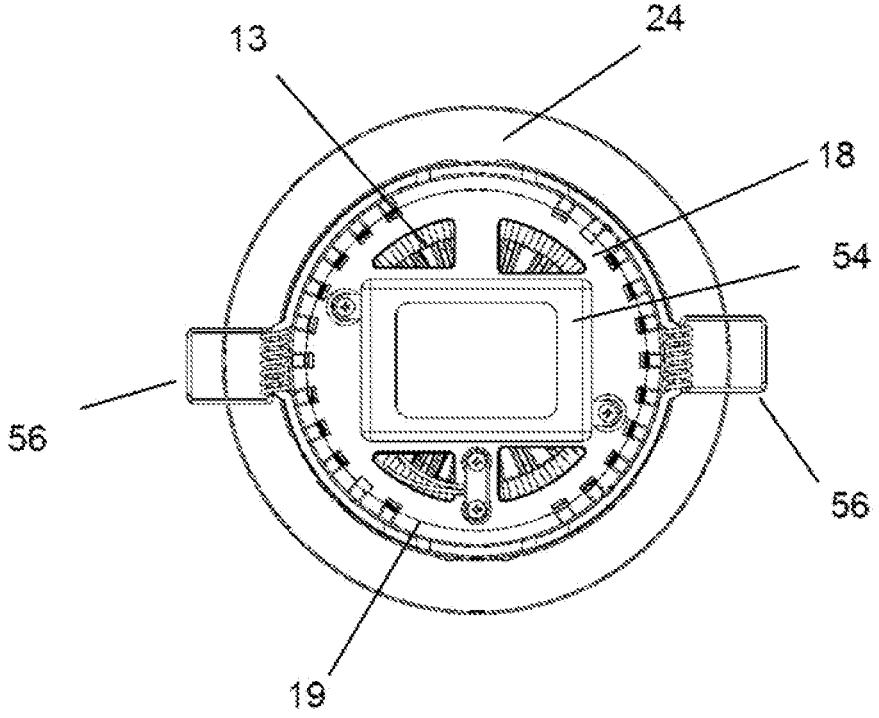
FIG. 10A is a top view of the light unit of FIG. 1 with the light module in the extended position.
Figure 10B:
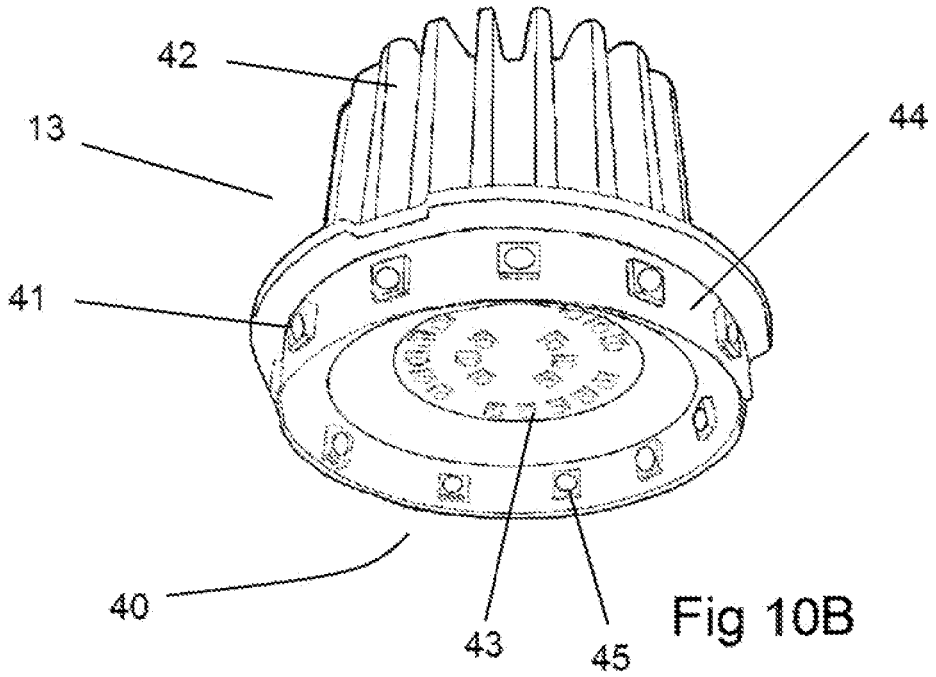
FIG. 10B is a lower view of the light module with the diffuser removed.
Figure 11B:
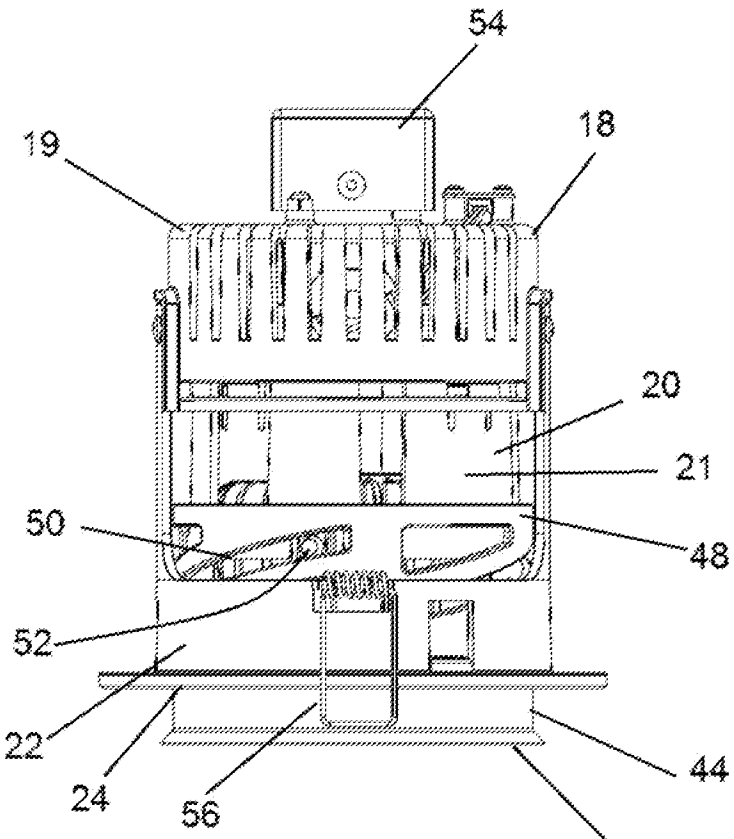
FIG. 11B is a second a side view of the light unit of FIG. 1 with the light module in the extended position.
Figure 11A:
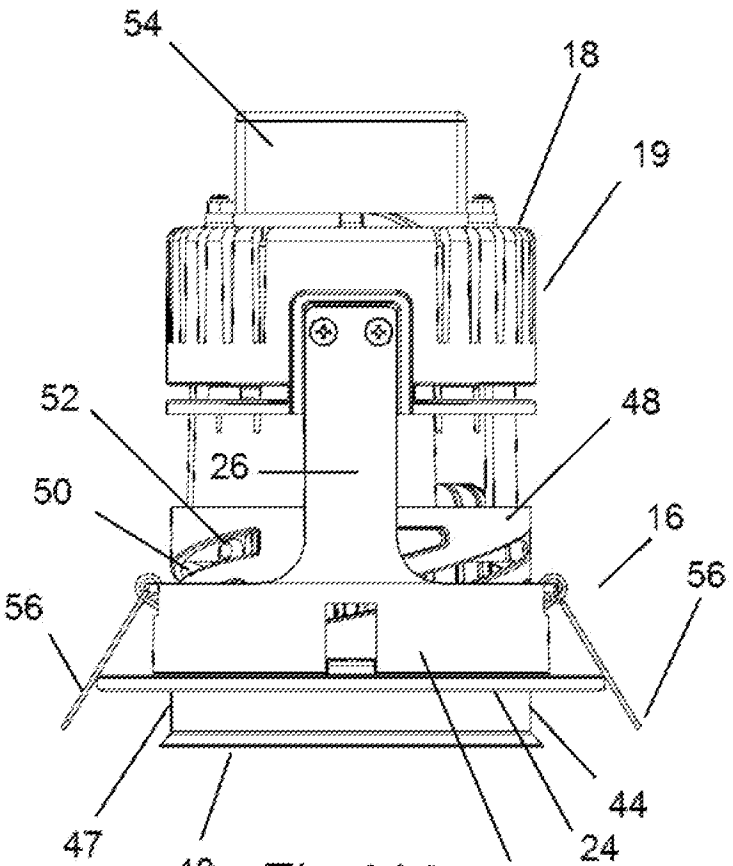
FIG. 11A is a first side view of the light unit of FIG. 1 with the light module in the extended position.

The lower end surface 40 may comprise a standard recess for receiving the LED light having a transparent diffuser located across the lower end surface 40. As shown in FIG. 10*b*, the recess in the lower end surface 40 may be provided with one or more sets of LED lights. In the embodiment of FIG. 10, there is provided a first set of LED lights 43 on a circular inner surface of the recess and a second set of LED lights 45 provided on an inner cylindrical surface of the recess. The first and second sets of LED lights 43 and 45 may be independently activated to provide different lighting effects.

The light module 13 includes also a second lighting emitting surface. The second lighting emitting surface comprises a side surface 44 of the light module 13. The side surface 44 comprises a cylindrical outer surface of the light module 13 located adjacent the lower end surface 40. In the embodiment shown, the second light emitting surface is provided with a second lighting device such that light is emitted radially outwardly by the second lighting device. The second lighting device comprises a light ring 46 having light emitting devices 41 secured around the periphery thereof, the light ring 46 being received about the cylindrical side surface 44.

The light module 13 is provided with a cover ring 47 provided to secure around the cylindrical side surface 44 and the light ring 46. The cover ring 47 is transparent such that light may be emitted outwardly through the cover ring 47.

The light module 13 is mounted relative to the housing 12 such that the light module 13 is movable between a retracted position and an extended position. When moving from the retracted position to the extended position, the light module 13 moves outwardly away from the housing 12. In the retracted position, the side surface 44 of the light module 13 is contained within the ring 22 of the fascia 16. That is, the lower end surface 40 is generally flush with the transverse flange 24 of the fascia 16.

Therefore, in the retracted position light may be emitted downwardly by the first lighting device but the second lighting device is covered. In the extended position, the cylindrical side surface 44 of the light module 13 moves downwardly below the transverse flange 24 of the fascia 16 such that it is exposed. Light may therefore be emitted radially outwardly from the second lighting device.

The light module 13 is moved between the extended and retracted positions by an actuator. In the embodiment shown the actuator comprises a motor 32 mounted to an inner surface of the first end of the body 18. The motor 32 is secured to the inner surface by a mounting bracket 38. The motor 32 includes a drive shaft 33 connected to a cog 34. The drive shaft 33 is oriented perpendicular to a central longitudinal axis of the body 18.

The frame 20 includes a plurality of teeth 36 around the periphery of the first end thereof. The cog 34 of the drive motor 32 is located such that the cog 34 engages with the teeth 36. Operation of the motor 32 therefore causes the frame 20 rotate about the central longitudinal axis thereof. The frame 20 can be caused to rotate in first and second directions by operation of the motor 32 in first and second rotational directions.

The light module 13 engages with the frame 20 by means of a third cylindrical member 48 secured around the outer surface of the light module 13. The third cylindrical member 48 includes a plurality of helical grooves 50 therein which receive lugs 52 provided on the outer surface of the second cylindrical member 21 adjacent the second end thereof.

As the frame 20 is rotated by the motor 32, the lugs 52 move within the helical grooves 50. This movement of the lugs 52 within the grooves 50 causes movement of the third cylindrical member 48 (and therefore the light module 13) in a direction parallel to the central longitudinal axis of the body 18. Therefore, rotation of the motor 32 in a first direction causes the light module 13 to move from the retracted to the extended position and operation of the motor 32 a second opposite direction causes the light module 13 to move from the extended position to the retracted position.

The light unit 10 is provided with a circuit housing 54. The circuit housing 54 is secured to an outer surface of the first end of the base 18 and is used to house electrical componentry required for operation of the light unit 10, such as a suitable transformer.

The fascia 16 is provided also with securing clips 56. The securing clips 56 are preferably spring biased and are provided to secure the fascia 16 within an opening provided in the mounting surface.

In use, the light unit 10 may be operated as a standard down light with the light module 13 in the retracted position. That is, operation of the first lighting device will emit light downwardly from the lower surface 40 in a known manner. The light unit 10 may also be operated in a second mode with the light module 13 in the extended position. In the extended position, the side surface 44 of the light module 13 is lowered below the fascia 16 such that light may be emitted radially outwardly from the cylindrical side surface 44. The second lighting device can therefore provide a lighting effect by radially lighting the surface of the ceiling to which the light unit 10 is mounted.

The second lighting device may be operated such that when the light module 13 is in the retracted position, the second lighting device is switched off. Alternatively, the light module 13 may have a mode of operation where the second lighting device is switched on while the light module 13 is in the retracted position. With such an arrangement, the second lighting device may provide a further effect of a ring of light emitted outwardly and downwardly from around the light module 13.

In a further embodiment, the second lighting device may be provided with a means for rotation. The means for rotation may comprise a stepper motor arranged such that the second lighting device rotates in a planetary motion relative to the housing to provide a further lighting effect when the second lighting device is in operation.

Figure 12:
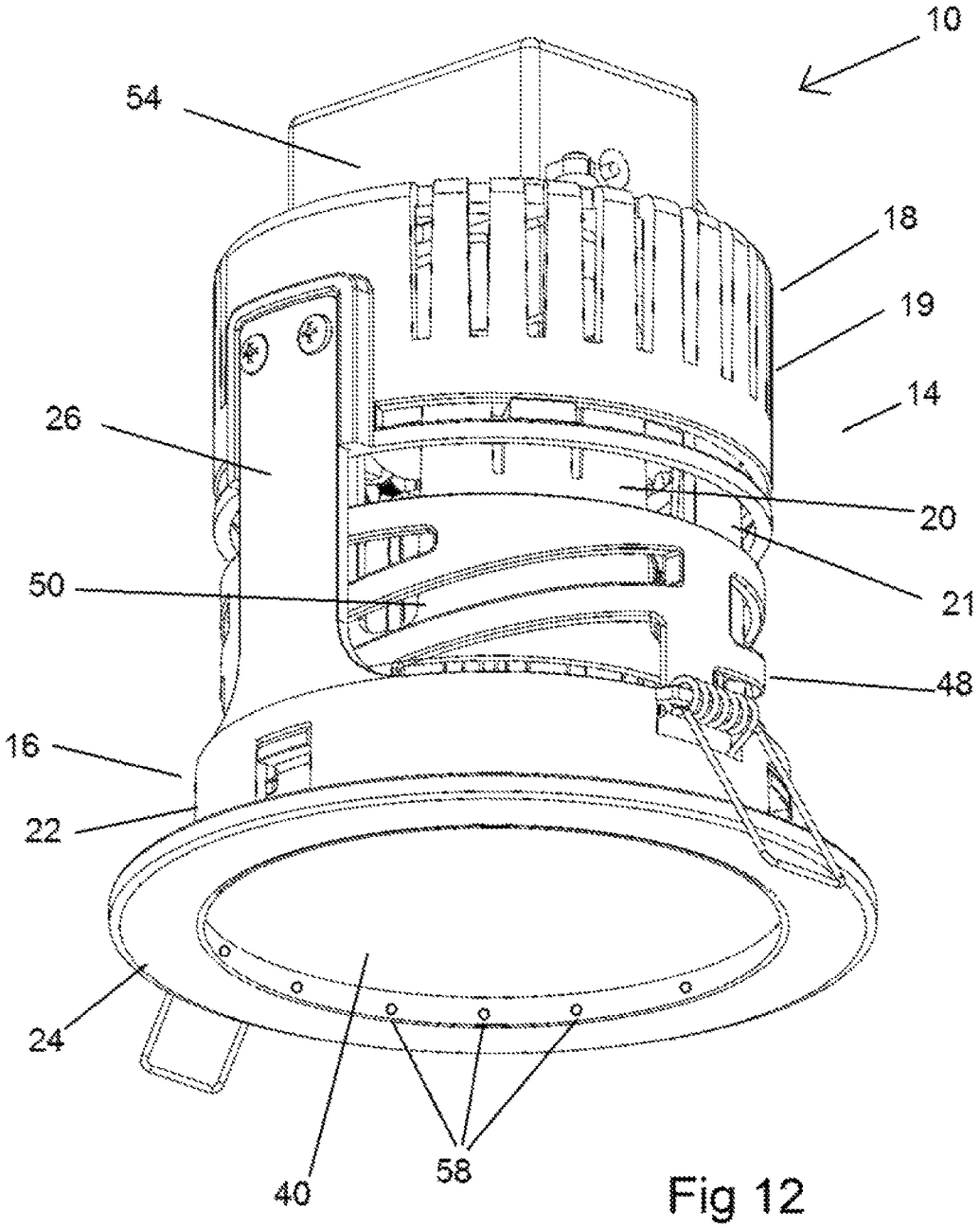
FIG. 12 is a lower perspective view of a second embodiment of a light unit in accordance with the present invention with the light module in a second retracted position.
Figure 13:
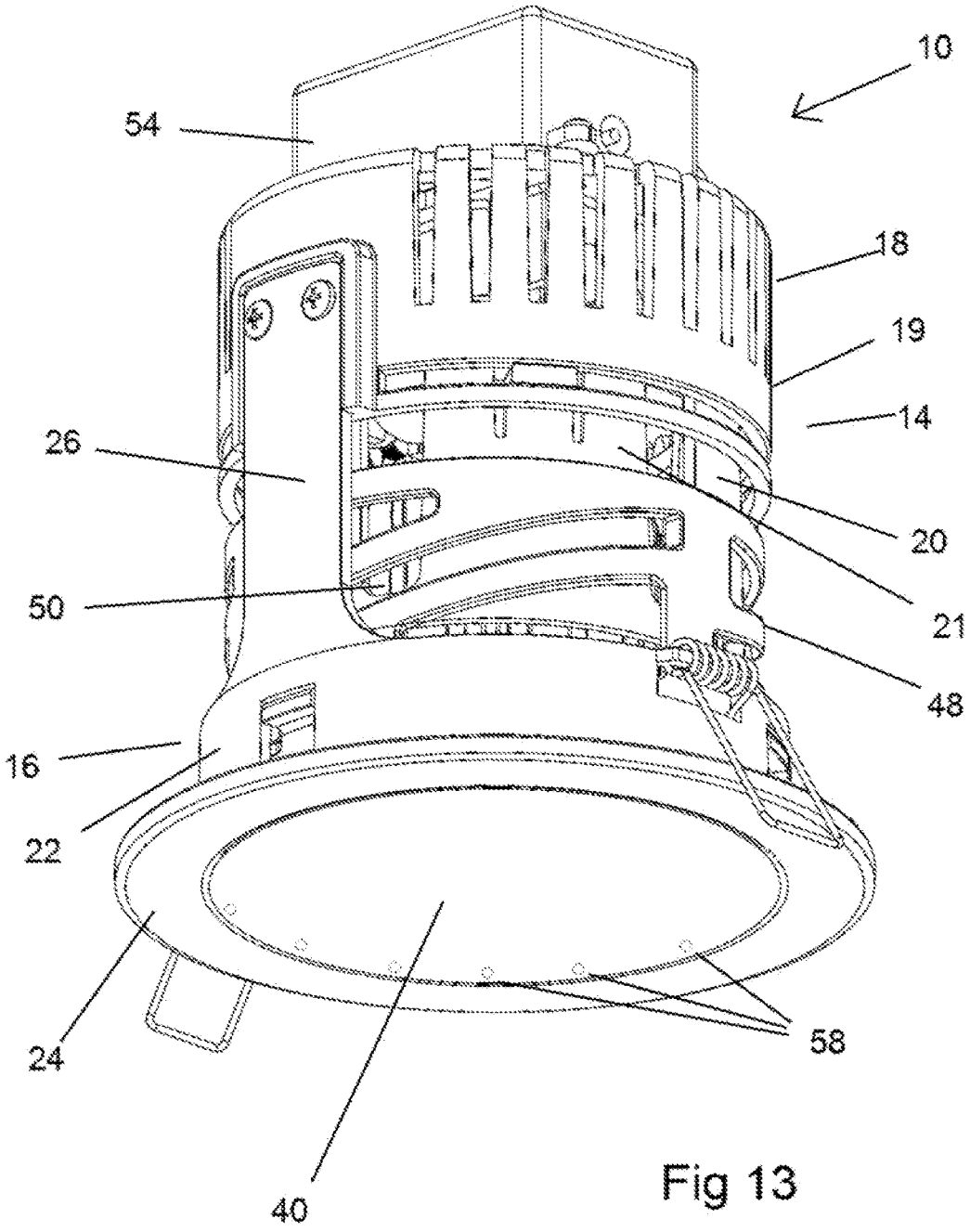
FIG. 13 is a lower perspective view of the light unit of FIG. 12 with the light module in the first retracted position.

FIGS. 12 and 13 show a second embodiment of a light unit 10 in accordance with the present invention. The light unit 10 of FIGS. 12 and 13 is similar to the embodiment of FIGS. 1 to 11 and like reference numbers are used to denote like parts.

The light unit 10 includes a third light emitting surface comprising a ring of inner lights 58, which are provided on an inner surface of the ring 22 of the fascia 16, adjacent the transverse flange 24. The light module 13 is moveable between first and second retracted positions. In the first retracted position (as shown in FIG. 13), the lower end surface 40 of the light module 13 is generally coplanar with the transverse flange and in the second retracted position (as shown in FIG. 12) the light module 13 is retracted further within the fascia 16 such that the lower end of the inner surface of the ring 22 is exposed. Therefore, in the second retracted position the inner lights 58 are exposed to provide a further lighting effect.

Figure 14A:
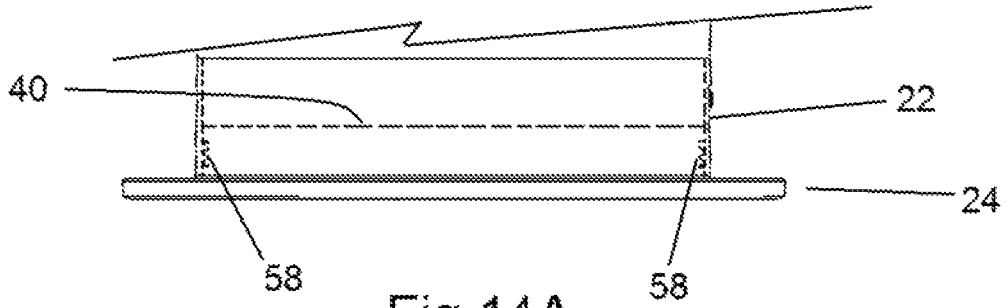
FIG. 14A is a side view of a lower portion of the light unit of FIG. 12 showing the lower end surface of the light module in the second retracted position.
Figure 14B:
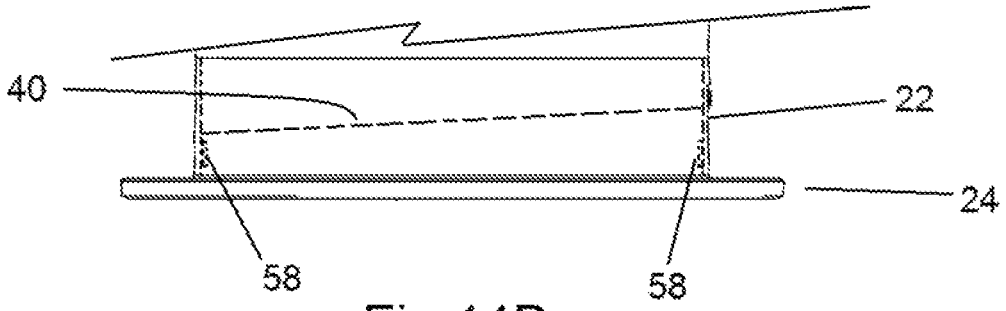
FIG. 14B is a side view of the lower portion of the light unit showing the lower end surface in a first tilted position.
Figure 14C:
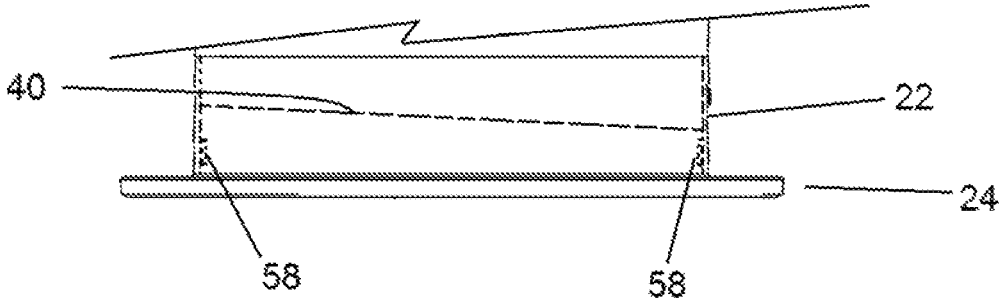
FIG. 14C is a side view of the lower portion of the light unit showing the lower end surface in a second tilted position.

The light module 13 in this embodiment may be mounted on a tilt mechanism (not shown). The tilt mechanism is provided to tilt the light module 13, and therefore the lower end surface 40, relative to the longitudinal axis of the housing 12. As some of the light emitted from the inner lights 58 will be directed upwardly and will be incident on the lower end surface 40, tilting of the lower end surface 40 will change the angle of the reflected light from the lower end surface 40. The tilt angle of the light module 13 may therefore be varied continuously to provide a further lighting effect by changing the reflected light direction from the inner lights 58. FIG. 14 shows views of the lower end surface 40 of the light module 13 at different tilt angles.

Figure 15:
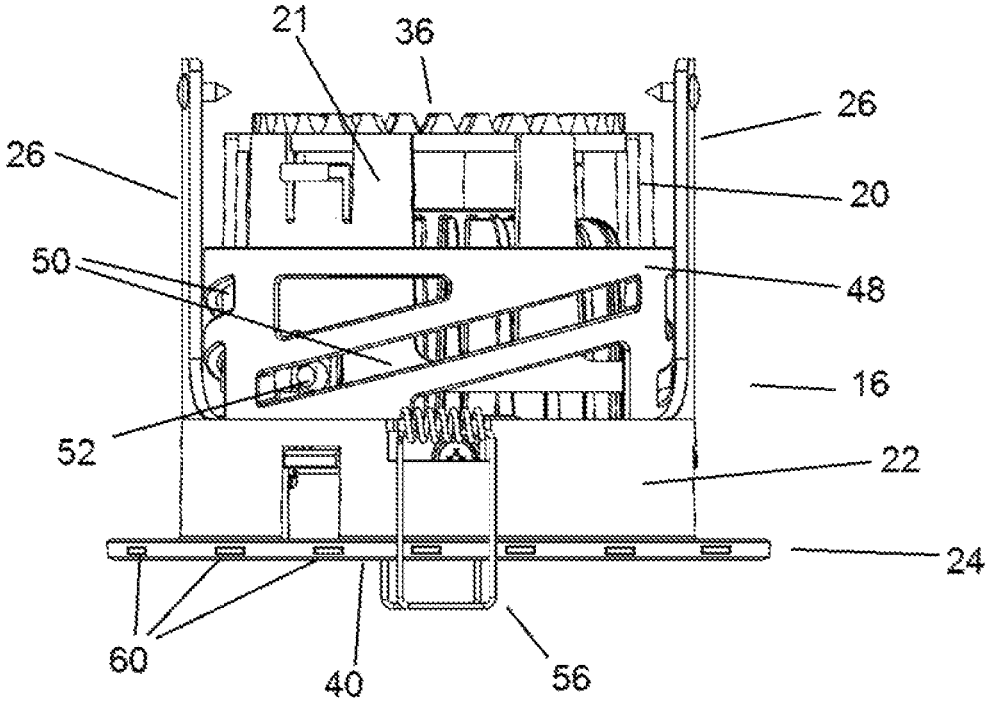
FIG. 15 is a side view of a third embodiment of a light unit including outer lights.

FIG. 15 shows a further embodiment of a light unit in accordance with the present invention. The light unit of FIG. 14 includes a plurality of outer lights 60. The outer lights 60 are provided around the periphery of the transverse flange 24 of the fascia 16 to provide a further lighting effect. A diffuser ring (not shown) may be provided around the periphery of the transverse flange 14 to diffuse the light from the outer lights 60.

FIG. 16 shows a further embodiment of a light unit 10 in accordance with the present invention. In the embodiment of FIG. 16, the light unit 10 comprises the housing 12 having a recess in a lower end such that the first lighting device is provided within the recess. The first lighting device may comprise LED lights 43. The light module 13 in this embodiment comprises a reflector 70 mounted for movement within the housing 12. The reflector 70 comprises a conical reflector having an opening 72 secured and a lip portion 71 around a lower edge.

Figure 16A:
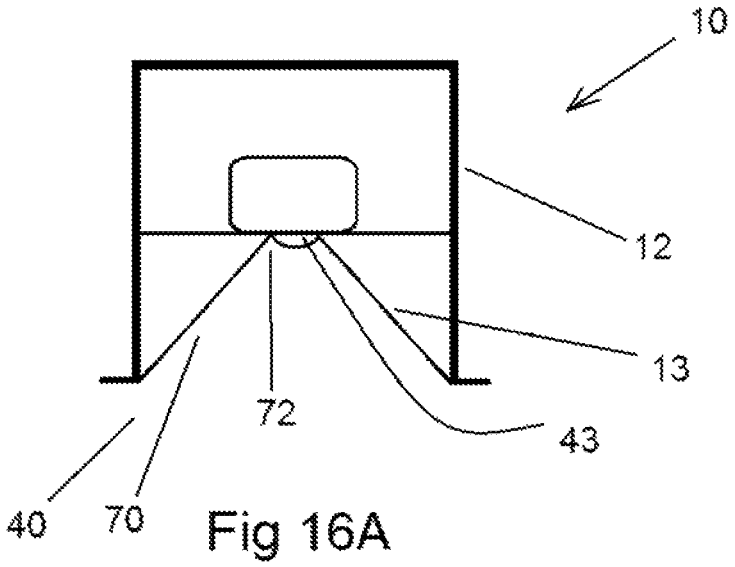
FIG. 16A is a side cross sectional view of a fourth embodiment of light unit in accordance with the present invention.
Figure 16B:
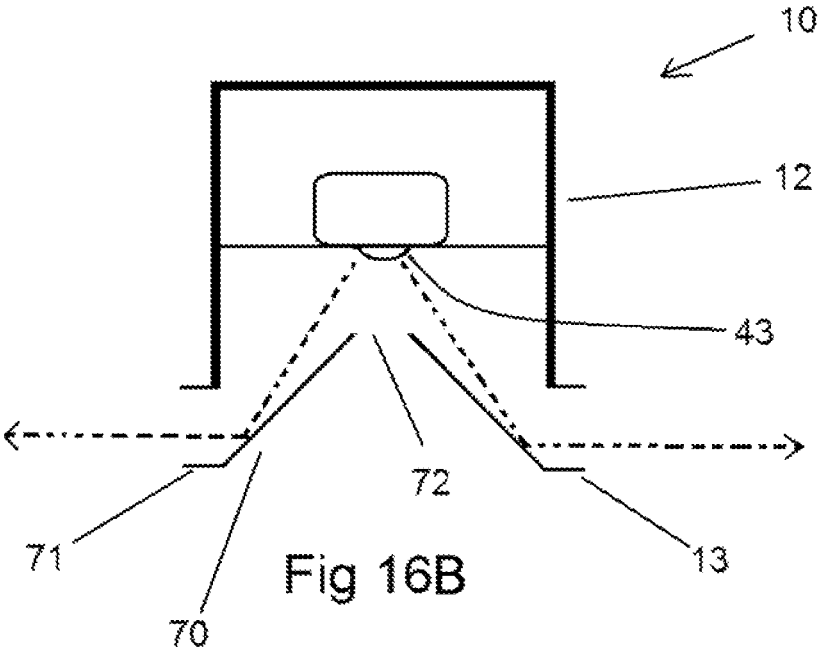
FIG. 16B is side cross sectional view of the light unit of FIG. 16A with the reflector in an extended position.

The light module 13 also moves between a retracted and an extended position. As shown in FIG. 16*a*, in the retracted position the opening 72 is adjacent the first lighting device and light is emitted downwardly through the opening 72 and out of the lower end surface 40. In the extended position, the reflector 70 moves downwardly such that light is incident on the upper surface of the reflector 70, which comprises the second light emitting surface. Light is reflected sideways (as shown in FIG. 16*b*) to pass outwardly between the reflector 70 and the lower edge of the housing 12.

It will be readily apparent to persons skilled in the relevant arts that various modifications and improvements may be made to the foregoing embodiments, in addition to those already described, without departing from the basic inventive concepts of the present invention.

What is claimed is:

1. A light unit comprising:

a housing securable to a mounting surface such that a lower end thereof is adjacent the lower surface of the mounting surface;

a light module mounted within the housing;

a first lighting emitting surface provided on a lower surface of the light module; and a second lighting emitting surface provided on a side surface of the light module;

wherein the light module is mounted for movement relative to the housing such that the light module is movable between a retracted position in which the first lighting emitting surface is exposed and the second lighting emitting surface is covered by the housing, and an extended position in which the second lighting emitting surface is exposed.

2. A light unit in accordance with claim 1, wherein the light module is cylindrical in shape such that the first light emitting surface comprises a circular lower end surface thereof and the second light emitting surface comprises a cylindrical side surface adjacent the lower surface.

3. A light unit in accordance with claim 2, wherein the first light emitting surface is provided with a first lighting device to emitting light downwardly therefrom and the second light emitting surface is provided with a second light emitting device to emit light radially outwardly therefrom.

4. A light unit in accordance with claim 3, wherein the housing comprises a base portion and a fascia wherein the fascia is to be secured adjacent the mounting surface and the light module is mounted for movement relative to the base portion.

5. A light unit in accordance with claim 4, wherein the base portion comprises a body and a frame connected to the body wherein the body comprises a first cylindrical member being open at a first end and the frame comprises a second cylindrical member received within the first cylindrical member.

6. A light unit in accordance with claim 5, wherein the second cylindrical member is movable relative to the first cylindrical member to cause the light module to move between the extended and retracted positions.

7. A light unit in accordance with claim 6, wherein the light module is engaged with the second cylindrical member such that rotation of the second cylindrical member causes translational movement of the light module between the extended and retracted positions.

8. A light unit in accordance with claim 7, wherein the light module includes a third cylindrical member secured around the outer surface thereof, the third cylindrical member including a plurality of helical grooves therein to receive lugs provided on the outer surface of the second cylindrical member such that rotation of the second cylindrical member causes translational movement of the third cylindrical member.

9. A light unit in accordance with claim 8, wherein a motor is mounted to an inner surface of the first end of the body provided to rotate the second cylindrical member.

10. A light unit in accordance with claim 9, wherein the motor includes a drive shaft connected to a cog which engages with a plurality of teeth around the periphery of the first end of the second cylindrical member.

11. A light unit in accordance with claim 10, wherein the fascia comprises a ring being cylindrical in shape having a transverse flange on a first side thereof and pair of arm members extending from a second side thereof to engage with an outer surface of the body.

12. A light unit in accordance with claim 11, wherein distal ends of the arm members engage into recesses on opposed sides of the first cylindrical member.

13. A light unit in accordance with claim 1, wherein the second lighting device comprises a light ring having light emitting devices secured around the periphery thereof, the light ring being received about the cylindrical side surface.

14. A light unit in accordance with claim 13, wherein a transparent cover ring is provided to secure around the cylindrical side surface and the light ring.

15. A light unit in accordance with claim 4, wherein a third light emitting surface is provided on an inner surface of the fascia and wherein the light module is moveable between first and second retracted positions such that the third light emitting surface is exposed by movement of the light module to the second retracted positon.

16. A light unit in accordance with claim 15, wherein the third light emitting surface comprises an inner surface of the ring of the fascia adjacent the transverse flange provided with inner lights and wherein the lower end surface of the light module is coplanar with the transverse flange in the first retracted position and retracted further within the fascia in the second retracted position.

17. A light unit in accordance with claim 16, wherein the light module includes a tilt mechanism provided to tilt the light module and therefore the lower end surface relative to the longitudinal axis of the housing to change the angle of the reflected light from the lower end surface.

18. A light unit in accordance with claim 11, wherein a plurality of outer lights are provided around the periphery of the transverse flange of the fascia.

19. A light unit in accordance with claim 18, wherein a diffuser ring is provided around the periphery of the transverse flange to diffuse the light from the outer lights.

20. A light unit in accordance with claim 1, wherein the light module comprises includes a reflector having an opening therein such that in the retracted light is emitted downwardly from a first lighting device through the opening and in the extended position, light is incident on the upper surface of the reflector and reflected sideways.

* * * * *